US010465406B2

(12) United States Patent
Arriaga

(10) Patent No.: US 10,465,406 B2
(45) Date of Patent: Nov. 5, 2019

(54) INTAKE SHIELD ASSEMBLY

(71) Applicant: Raymond Arriaga, Poinciani, FL (US)

(72) Inventor: Raymond Arriaga, Poinciani, FL (US)

( * ) Notice: Subject to any disclaimer, the term of this patent is extended or adjusted under 35 U.S.C. 154(b) by 0 days.

(21) Appl. No.: 15/849,780

(22) Filed: Dec. 21, 2017

(65) Prior Publication Data

US 2019/0194967 A1 Jun. 27, 2019

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.19, 167.2, 232
See application file for complete search history.

(56) References Cited

U.S. PATENT DOCUMENTS 5,336,400 A 8/1994 patrice
5,391,296 A 2/1995 Rotundo et al.
5,525,217 A * 6/1996 Fulop ..... B01D 21/2433 210/167.18
5,706,530 A * 1/1998 Mariano ..... E04H 4/1272 138/32
5,753,113 A 5/1998 Hendricks
5,804,064 A * 9/1998 Desrochers ..... E04H 4/1254 210/167.18
D437,465 S 2/2001 Radsky
6,315,911 B1 11/2001 Radsky
8,726,428 B2 5/2014 Nelson
2004/0011717 A1* 1/2004 Foley ..... E04H 4/1272 210/167.1
2008/0073257 A1* 3/2008 Foley ..... E04H 4/1272 210/167.1
2016/0251866 A1 9/2016 Greenwald

* cited by examiner

*Primary Examiner* — Fred Prince

(57) ABSTRACT

An intake shield assembly for inhibiting a pool skimmer from being plugged includes a pipe that is extended into an intake of a pool skimmer thereby inhibiting objects from entering the intake. A pair of arms is provided and each of the arms is coupled to the pipe. Each of the arms abuts a wall of the pool when the pipe is extended into the intake thereby inhibiting the pipe from being drawn fully into the intake. An elbow is provided and the elbow is positioned in the intake of the pool skimmer. The elbow is fluidly coupled to the pipe when the pipe is extended into the intake. In this way the elbow inhibits objects from plugging the intake.

8 Claims, 6 Drawing Sheets

INTAKE SHIELD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shield devices and more particularly pertains to a new shield device for inhibiting a pool skimmer from being plugged.

BRIEF SUMMARY OF THE INVENTION

An embodiment of the disclosure meets the needs presented above by generally comprising a pipe that is extended into an intake of a pool skimmer thereby inhibiting objects from entering the intake. A pair of arms is provided and each of the arms is coupled to the pipe. Each of the arms abuts a wall of the pool when the pipe is extended into the intake thereby inhibiting the pipe from being drawn fully into the intake. An elbow is provided and the elbow is positioned in the intake of the pool skimmer. The elbow is fluidly coupled to the pipe when the pipe is extended into the intake. In this way the elbow inhibits objects from plugging the intake.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
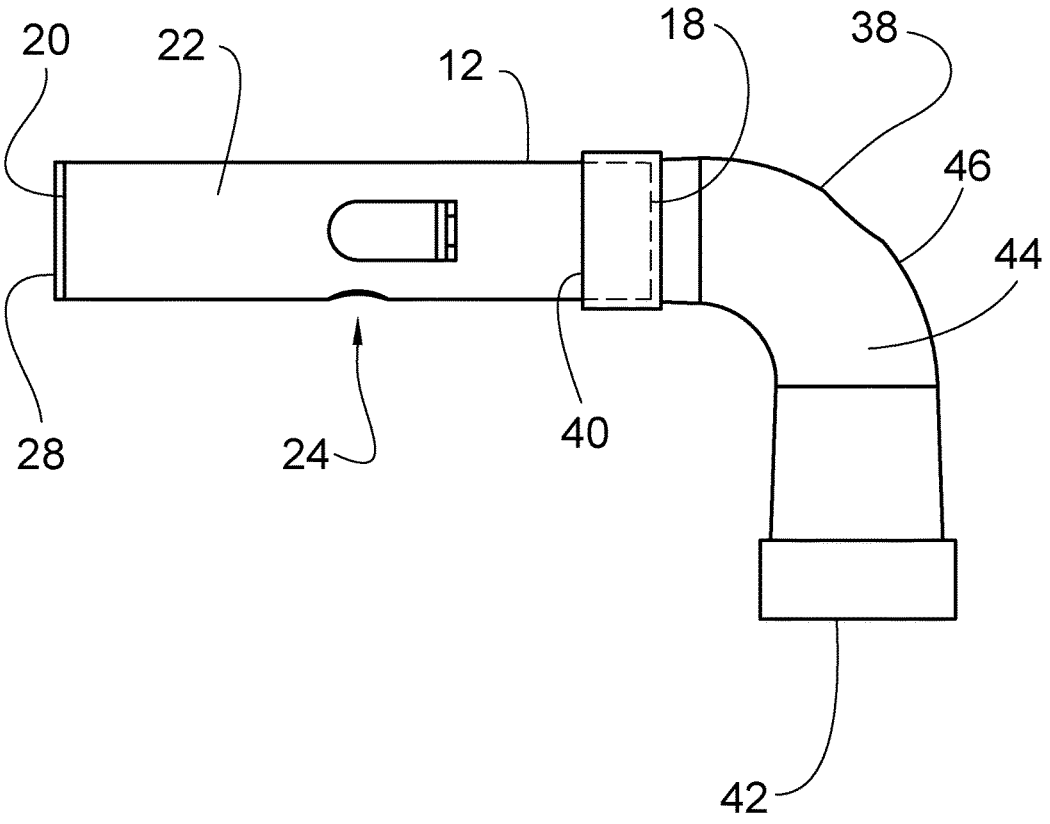
FIG. 1 is a right side view of an intake shield assembly according to an embodiment of the disclosure.
Figure 2:
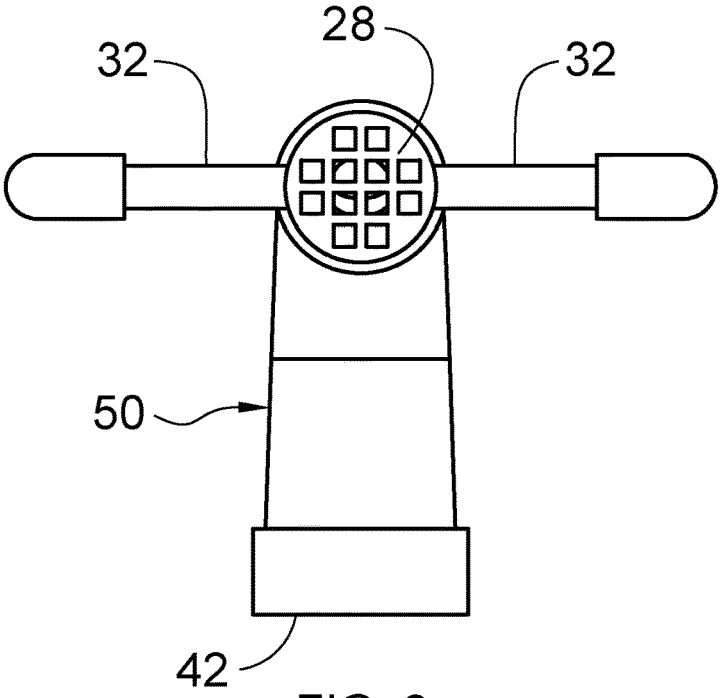
FIG. 2 is a front view of an embodiment of the disclosure.
Figure 3:
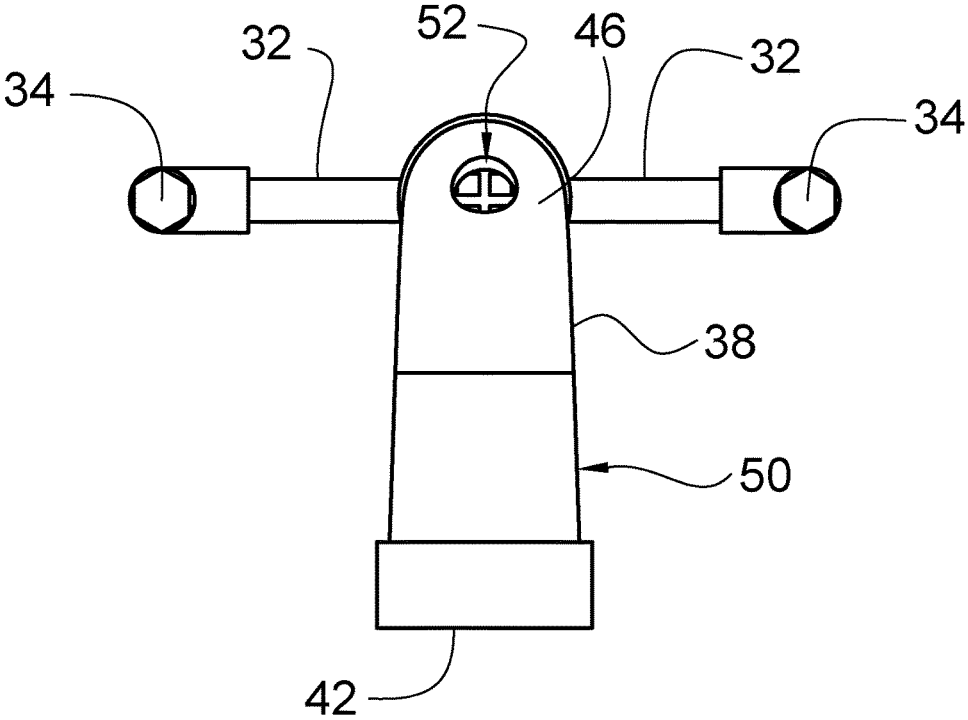
FIG. 3 is a back view of an embodiment of the disclosure.
Figure 4:
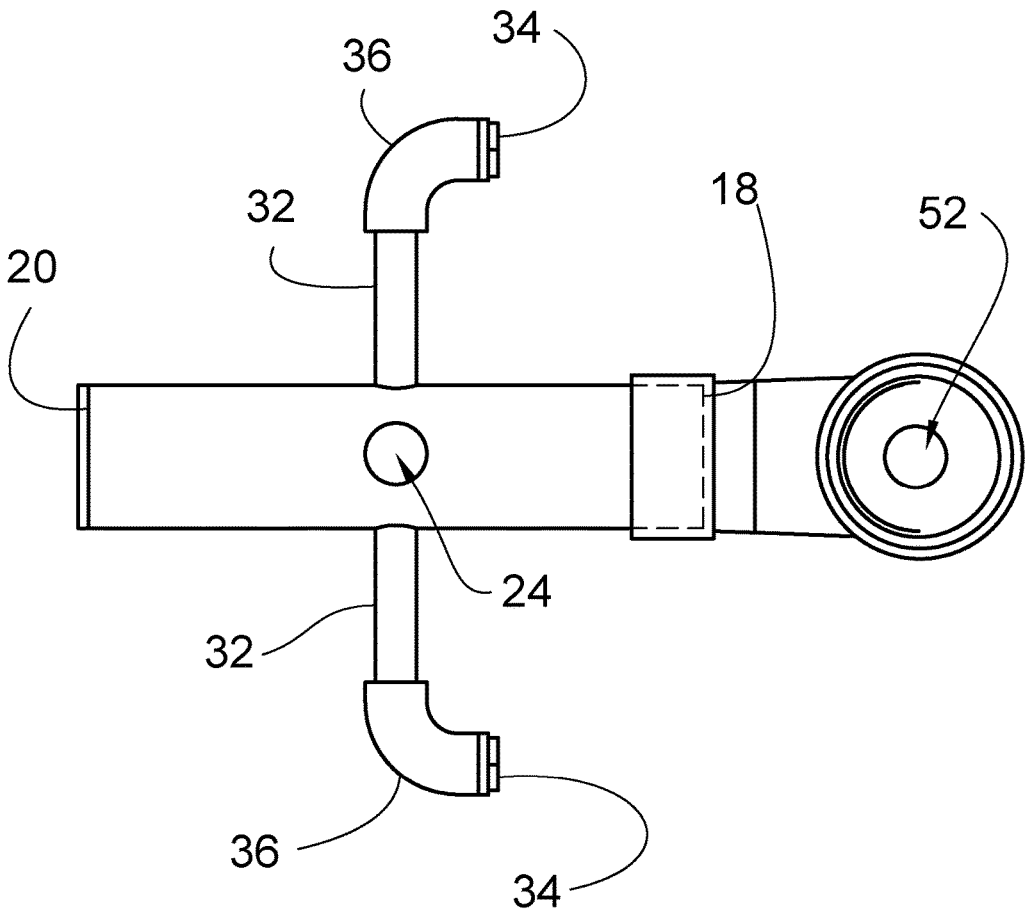
FIG. 4 is a bottom view of an embodiment of the disclosure.
Figure 5:
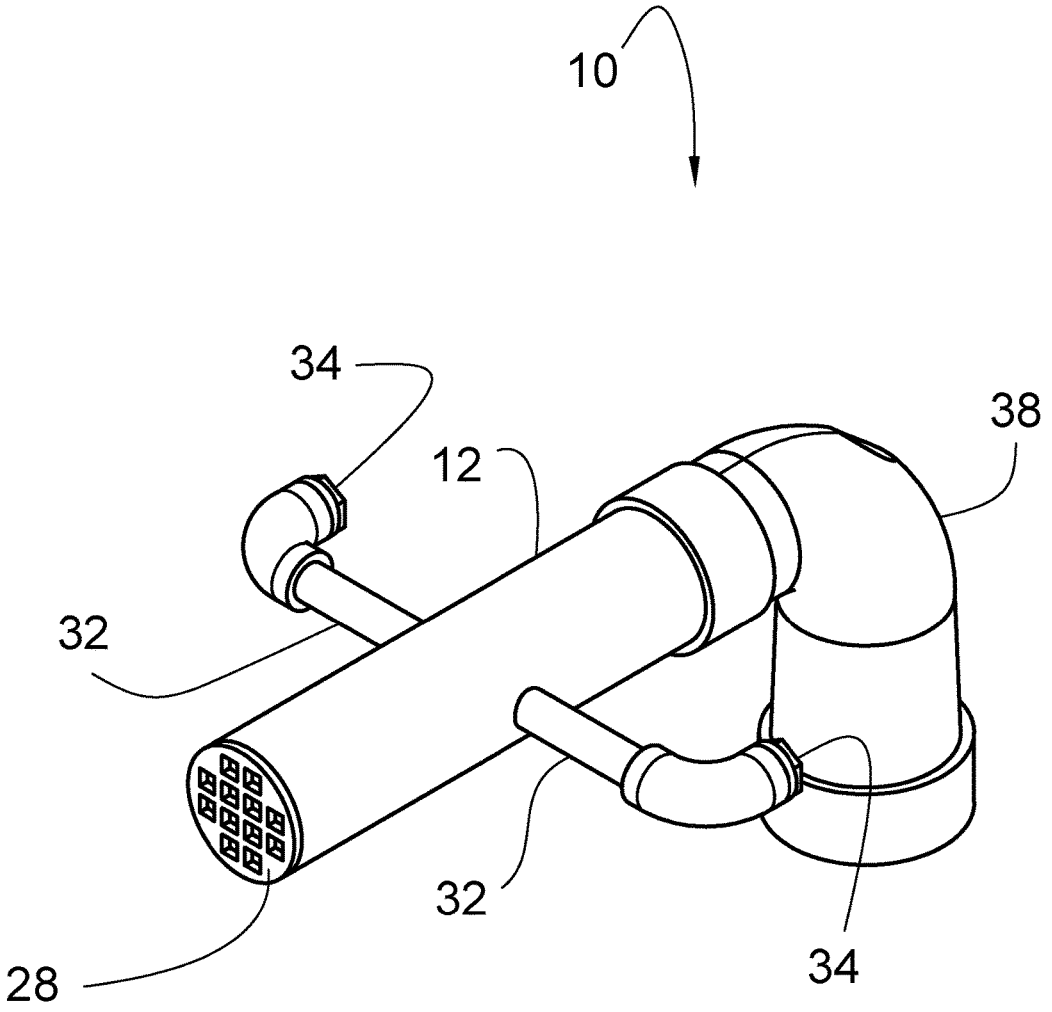
FIG. 5 is a perspective view of an embodiment of the disclosure.
Figure 6:
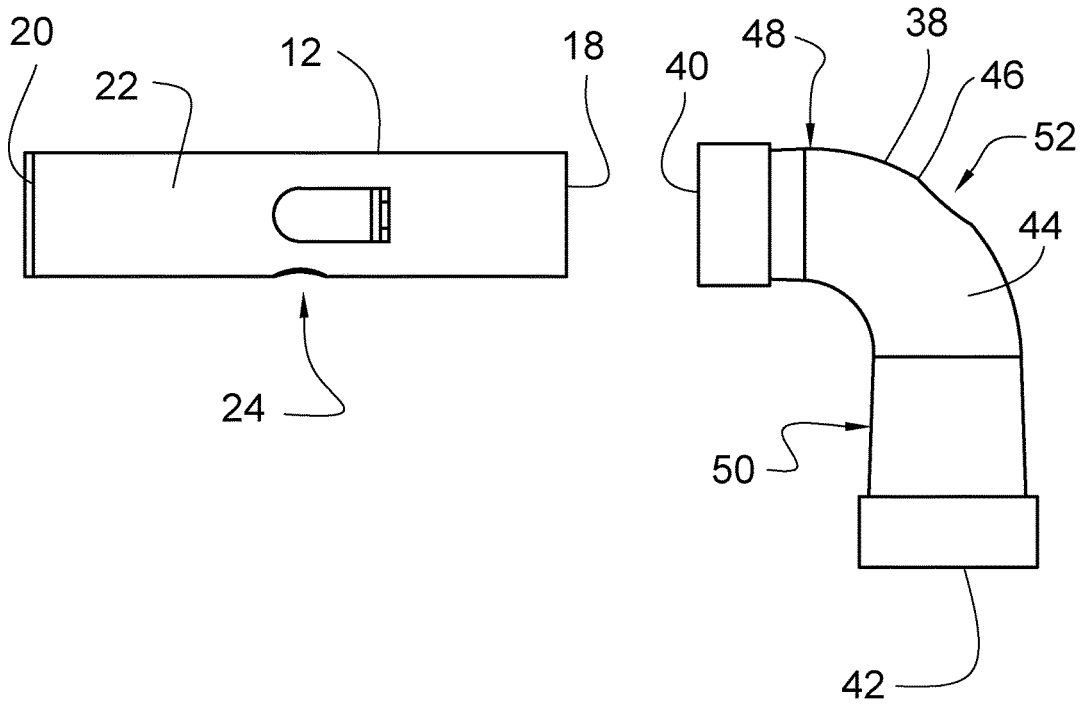
FIG. 6 is an exploded right side view of an embodiment of the disclosure.
Figure 7:
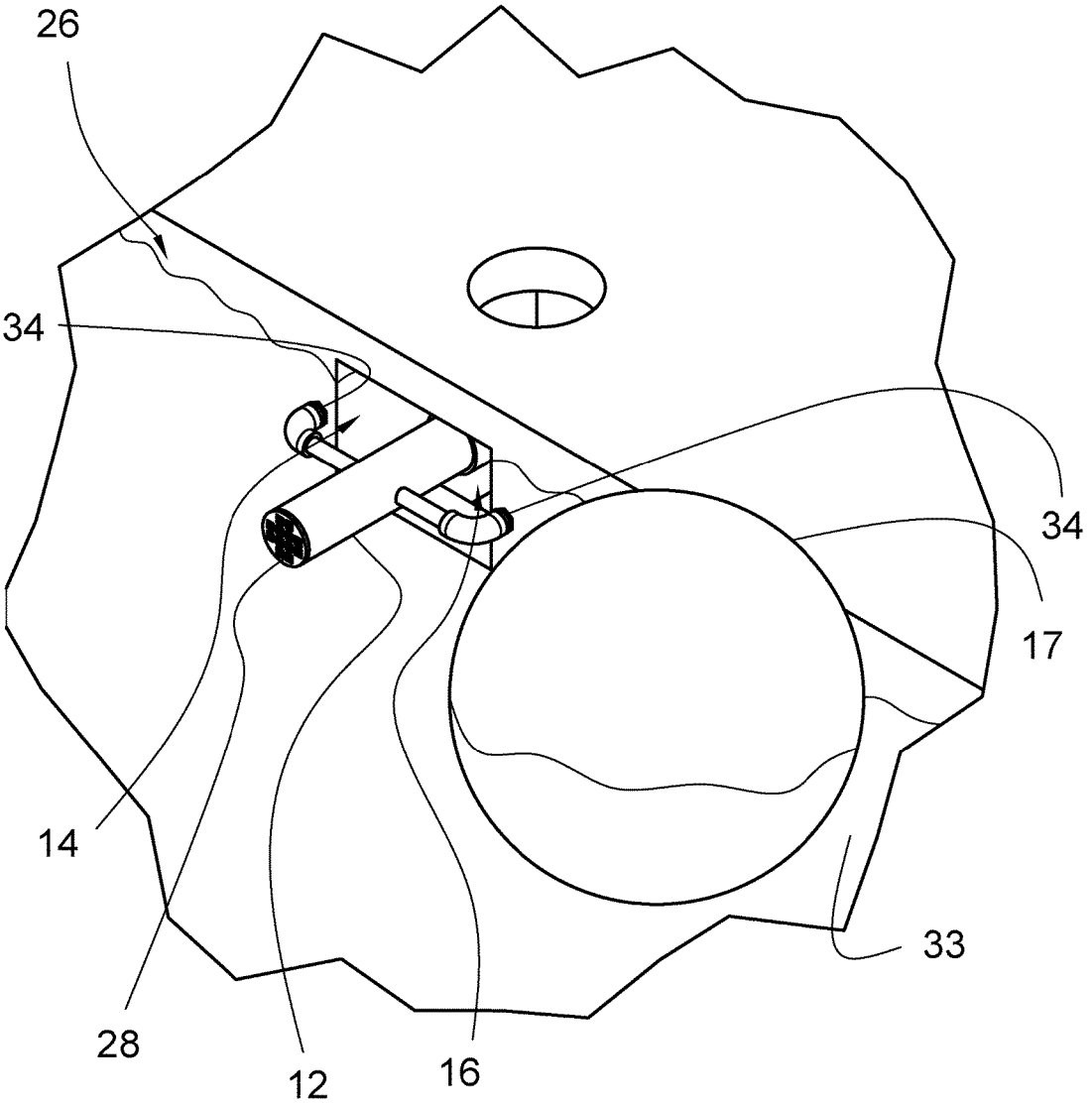
FIG. 7 is a perspective in-use view of an embodiment of the disclosure.

With reference now to the drawings, and in particular to FIGS. 1 through 7 thereof, a new shield device embodying the principles and concepts of an embodiment of the disclosure and generally designated by the reference numeral 10 will be described.

As best illustrated in FIGS. 1 through 7, the intake shield assembly 10 generally comprises a pipe 12 that may be extended into an intake 14 of a pool skimmer 16 thereby inhibiting objects 17 from entering the intake 14. The pipe 12 has a first end 18, a second end 20 and outer wall 22 extending therebetween. The outer wall 22 has an aperture 24 extending into an interior of the pipe 12 to pass fluid into the pipe 12. The first end 18 is positioned in the intake 14 and the second end 20 is positioned in a pool 26. The pool 26 may be a chlorinated swimming pool and the pool skimmer 16 may be a swimming pool skimmer 16 that employs a water pump. Moreover, the pipe 12 may have a length ranging between approximately 30.0 cm and 60.0 cm.

A screen 28 is coupled to the second end 20 of the pipe 12 to inhibit objects 17 from entering the pipe 12. The screen 28 is comprised of a fluid permeable material to pass fluid into the pipe 12. Moreover, the aperture 24 passes fluid into the pipe 12 when the second end 20 of the pipe 12 becomes plugged by the object 17. In this way a constant flow of the fluid is provided to the pool skimmer 16 thereby inhibiting the pool skimmer's 16 fluid pump from being damaged by a lack of fluid.

A pair of arms 32 is provided and each of the arms 32 is coupled to the pipe 12. Each of the arms 32 abuts a wall 33 of a pool 26 when the pipe 12 is extended into the intake 14. In this way the arms 32 inhibit the pipe 12 from being drawn fully into the intake 14. Each of the arms 32 is positioned on the outer wall 22 of the pipe 12 and each of the arms 32 has a distal end 34 with respect to the outer wall 22. Each of the arms 32 has a bend 36 that is positioned between the distal end 34 and the pipe 12. Thus, the distal end 34 corresponding to each of the arms 32 is directed towards the first end 18 of the pipe 12. Each of the arms 32 is centrally positioned between the first end 18 and the second end 20 and the distal end 34 corresponding to each of the arms 32 abuts the wall 33 of the pool 26.

An elbow 38 is provided and the elbow 38 is positioned in the intake 14 of the pool skimmer 16 to inhibit objects 17 from plugging the intake 14. The elbow 38 is fluidly coupled to the pipe 12 when the pipe 12 is extended into the intake 14. The elbow 38 has a primary end 40, a secondary end 42 and an outside wall 44 extending therebetween. The elbow 38 is hollow and each of the primary end 40 and the secondary end 42 is open. The elbow 38 has a bend 46 thereon to define a first half 48 of the elbow 38 forming an angle with a second half 50 of the elbow 38.

The primary end 40 insertably receives the first end 18 of the pipe 12 and the second half 50 of the elbow 38 extends downwardly in the intake 14. The outside wall 44 has an aperture 52 extending into an interior of the elbow 38 to pass fluid into the elbow 38 when the pipe 12 becomes plugged. The aperture 52 on the elbow 38 is positioned on the bend 46 on the elbow 38. Each of the pipe 12, the arms 32 and the elbow 38 may comprise schedule 40 PVC pipe 12 or the like.

In use, the elbow 38 is positioned in the intake 14 and the pipe 12 is extended into the intake 14 from the pool 26. The first end 18 of the pipe 12 is fluidly coupled to the primary end 40 of the elbow 38. Additionally, the pipe 12 is positioned such that each of the arms 32 abuts the wall 33 of the pool 26. Each of the arms 32 has a length that is sufficient to extend laterally across the opening in the wall 33 of the pool 26 that leads to the intake 14. Thus, the pipe 12 and each of the arms 32 inhibits objects 17, such as floating pool 26 toys and the like, from entering and potentially clogging the intake 14. Moreover, the elbow 38 inhibits objects 17 from entering the intake 14 from outside of the pool 26 via an access hole. The aperture in the pipe 12 and the aperture in the elbow 38 ensure that a constant flow of fluid is available to the skimmer regardless if the second end 20 of the pipe 12 becomes plugged by an object. In this way the fluid pump in the skimmer is protected from damage resulting in restricted fluid flow to the fluid pump.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An intake shield assembly being configured to be positioned in an intake of a pool skimmer thereby inhibiting objects from entering the intake, said assembly comprising:

a pipe being configured to be extended into an intake of a pool skimmer thereby inhibiting objects from entering the intake;

a pair of arms, each of said arms being coupled to said pipe wherein each of said arms is configured to abut a wall of the pool when said pipe is extended into the intake thereby inhibiting said pipe from being drawn fully into the intake;

an elbow configured to be positioned in the intake of the pool skimmer, said elbow being fluidly coupled to said pipe when said pipe is extended into the intake wherein said elbow is configured to inhibit objects from plugging the intake; and wherein said pipe has a first end, a second end and outer wall extending therebetween, said outer wall having an aperture extending into an interior of said pipe wherein said aperture is configured to pass fluid into said pipe, said first end being configured to be positioned in the intake having said second end being positioned in a pool.

2. The assembly according to claim 1, further comprising a screen being coupled to said second end of said pipe wherein said screen is configured to inhibit objects from entering said pipe, said screen being comprised of a fluid permeable material wherein said screen is configured to pass fluid into said pipe, said aperture being configured to pass fluid into said pipe when said second end of said pipe becomes plugged by an object thereby facilitating a constant flow of the fluid to the pool skimmer.

3. The assembly according to claim 2, wherein each of said arms is positioned on said outer wall of said pipe, each of said arms having a distal end with respect to said outer wall.

4. The assembly according to claim 3, wherein each of said arms has a bend being positioned between said distal end and said pipe such that said distal end corresponding to each of said arms is directed towards said first end of said pipe, each of said arms being centrally positioned between said first end and said second end, said distal end corresponding to each of said arms being configured to abut the wall of the pool.

5. The assembly according to claim 4, wherein said elbow has a primary end, a secondary end and an outside wall extending therebetween, said elbow being hollow, each of said primary end and said secondary end being open, said elbow having a bend thereon to define a first half of said elbow forming an angle with a second half of said elbow.

6. The assembly according to claim 5, wherein said primary end insertably receives said first end of said pipe wherein said second half of said elbow is configured to extend downwardly in the intake.

7. The assembly according to claim 6, wherein said outer wall has an aperture extending into an interior of said elbow wherein said aperture is configured to pass fluid into the elbow when said pipe becomes plugged, said aperture being positioned on said bend on said elbow.

8. An intake shield assembly being configured to be positioned in an intake of a pool skimmer thereby inhibiting objects from entering the intake, said assembly comprising:

a pipe being configured to be extended into an intake of a pool skimmer thereby inhibiting objects from entering the intake, said pipe having a first end, a second end and outer wall extending therebetween, said outer wall having an aperture extending into an interior of said pipe wherein said aperture is configured to pass fluid into said pipe, said first end being configured to be positioned in the intake having said second end being positioned in a pool;

a screen being coupled to said second end of said pipe wherein said screen is configured to inhibit objects from entering said pipe, said screen being comprised of a fluid permeable material wherein said screen is configured to pass fluid into said pipe, said aperture being configured to pass fluid into said pipe when said second end of said pipe becomes plugged by an object thereby facilitating a constant flow of the fluid to the pool skimmer;

a pair of arms, each of said arms being coupled to said pipe wherein each of said arms is configured to abut a wall of a pool when said pipe is extended into the intake thereby inhibiting said pipe from being drawn fully into the intake, each of said arms being positioned on said outer wall of said pipe, each of said arms having a distal end with respect to said outer wall, each of said arms having a bend being positioned between said distal end and said pipe such that said distal end corresponding to each of said arms is directed towards said first end of said pipe, each of said arms being centrally positioned between said first end and said second end, said distal end corresponding to each of said arms being configured to abut the wall of the pool; and an elbow configured to be positioned in the intake of the pool skimmer, said elbow being fluidly coupled to said pipe when said pipe is extended into the intake wherein said elbow is configured to inhibit objects from plugging the intake, said elbow having a primary end, a secondary end and an outside wall extending therebetween, said elbow being hollow, each of said primary end and said secondary end being open, said elbow having a bend thereon to define a first half of said elbow forming an angle with a second half of said elbow, said primary end insertably receiving said first end of said pipe wherein said second half of said elbow is configured to extend downwardly in the intake, said outer wall having an aperture extending into an interior of said elbow wherein said aperture is configured to pass fluid into the elbow when said pipe becomes plugged, said aperture being positioned on said bend on said elbow.

* * * * *